US005711417A

United States Patent [19]

Tilve

[11] Patent Number: 5,711,417

[45] Date of Patent: Jan. 27, 1998

[54] CASE FOR GLASSES

[76] Inventor: Enrique Jesus Ramon Tilve, Gualeguaychu 2360, Capital Federal, Buenos Aires, Argentina, 1417

[21] Appl. No.: 612,281

[22] Filed: Mar. 7, 1996

[30] Foreign Application Priority Data

Mar. 9, 1995 [AR] Argentina ..... 331.289
Jun. 1, 1995 [AR] Argentina ..... 332.257

[51] Int. Cl.[6] ..... A45C 11/04

[52] U.S. Cl. ..... 206/6; 206/1.5; 270/326

[58] Field of Search ..... 206/5, 6, 1.5; 220/326, 220/328

[56] References Cited

U.S. PATENT DOCUMENTS 4,561,544 12/1985 Reeve ..... 220/246 X 5,267,668 12/1993 Jones ..... 220/326

*Primary Examiner*—Jacob K. Ackun

*Attorney, Agent, or Firm*—Darby & Darby

[57] ABSTRACT

A case for glasses with a closing mechanism comprising a pair of flexible arms extending from the walls of the top of the case. Each flexible arm terminates with a wedge shaped cam. A pair of holes in the walls of the bottom of the case are present at points opposing the cams. When the case is closed, the cams engage the bottom walls, forcing the flexible arms inward. When the case is fully closed, the cams engage the opposing holes and thus secure the case in the closed position. The case may be opened by pressing the cams inward.

7 Claims, 4 Drawing Sheets a'
10
d'
10"
18
19
b'
11
c'
12
13
11'
10' a'
10'
10
14'
c'
13
12
14
b'
11 d'
15
16
b'
11
19
12
c'
11'
10"
17
11"

CASE FOR GLASSES

The present invention relates to improvements in cases for storing glasses. Its purpose is to provide a system to shut a case in a completely secure way and to avoid the problem of accidental opening that occurs as conventional shutting means wear out.

Different types of cases for glasses are known. One conventional case has a totally flexible constitution. Three of its edges are joined. The remaining edge has mouth to its interior by which the glasses are introduced.

The cases of this type are the most commonly used, but have as a disadvantage that, due to the open inlet mouth, it is frequent that the glasses slide out and fall, occasioning breakage and various damage.

In order to solve these problems, the present invention comprises a case with a quite safe shutting system based on a set of cams which are projected from respective flexibly ceding arms. Each can wedges at wedging ends into an opposing hole, thus preventing these type of accidents.

Another conventional case is one having a zipper disposed in one of their longitudinal walls. In this case, the intensive use of the zipper due to continuous extraction and introduction of the glasses causes it to quickly wear away allowing the case to accidently open, facilitating the dropping of the element that the case contains.

On the other hand, the case which is the object of the invention has a cam system and wedging openings in the respective ends that, due to their constitution and function, are quite durable and suffer from only minimal wear.

Conventional cases are also known that have a shutting system based on two metallic flexibly ceding arms that project from their respective longitudinal shutting walls and mutually intercrossing at their engrossed free ends when the case is closed. These type of cases have the problem that their arms suffer plastic deformations that shortens their useful life due to the great displacement that must occur when their ends intercross.

To solve this problem, the present invention has a set of clams that are forcibly wedgable in corresponding wedging openings in such a way that the top face of each cam is left exposed in said opening so it may be pressed during the opening of the case. The comparative advantage of this system over the above-mentioned prior art is that the necessary displacement of the cam to open and close the case reduced, thus the reducing wearing of the material of the flexibly cedent arms and increasing the efficiency and the useful life of the case.

There are also conventional cases which are generally rigid and have a shutting means comprising a flexibly ceding flap projected from one of the shutting walls. Said flap, is kept closed by a ledge wedgable in a wedging means provided in the opposing shutting wall. The flap is opened with a commanding rod that goes through the shutting wall. The most frequent problem that this type of case present is that the rod gets stuck which, according to the position in which it gets stuck, prevents the proper opening or closing of the case.

The present invention eliminates this because as the same cam that composes a shutting means constitutes at the same time an opening means commandable through the opening into which the cam is wedged. In this way, the retentive element is permanently exposed and may be readily released by the user, in contrast with conventional cases where the shutting element is left in an inaccessible position once the case has been shut.

Another type of conventional case has a shutting means which is engaged by wedging cams into opening located in the same side wall. This mechanism is inconvenient to open.

The present invention solves this problem placing the shutting means in two opposed lateral walls that are not the opening walls. This complementarily arrangement facilitates the handling when the case is opened.

Furthermore, the present case allows different embodiments according to different necessities. In this way, a case can be composed with shorter longitudinal lateral walls that continue themselves with respective shutting means, allowing a saving of material.

Also, in another embodiment, the present invention may comprise a case with both boxes laterally shut by means of their corresponding walls. Thus, a more appropriate case is obtained for those who require an increased protection of their glasses, as both opposing boxes define a completely shut receptacle. In this aspect, the case is equally apt to be used with contact lenses.

BRIEF DESCRIPTION OF THE DRAWINGS

For an increased clarity and comprehension of the object of the invention, the same is illustrated with various figures which represent one of the preferred embodiments. The figures are an illustrative example, not limitative.

In different figures, the same reference numbers indicate corresponding or equal parts, and the set of various elements have been marked with letters.

Figure 1:
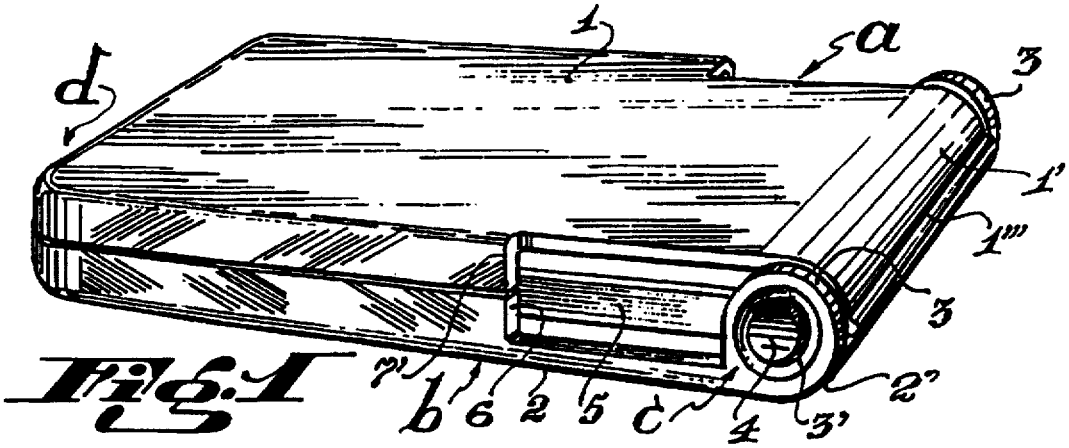
FIG. 1 is a view in perspective of the case in a shut position, in which its general conformation can be observed.
Figure 2:
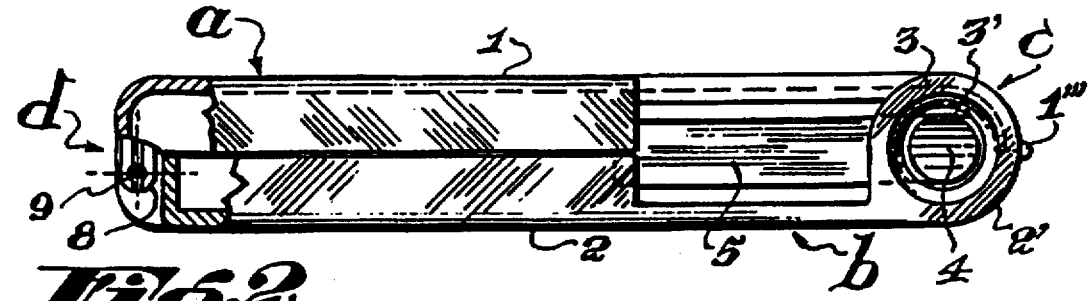
FIG. 2 is side view with a partial section that makes evident the hinging means, while in the opposite end the shutting means are observed.
Figure 3:
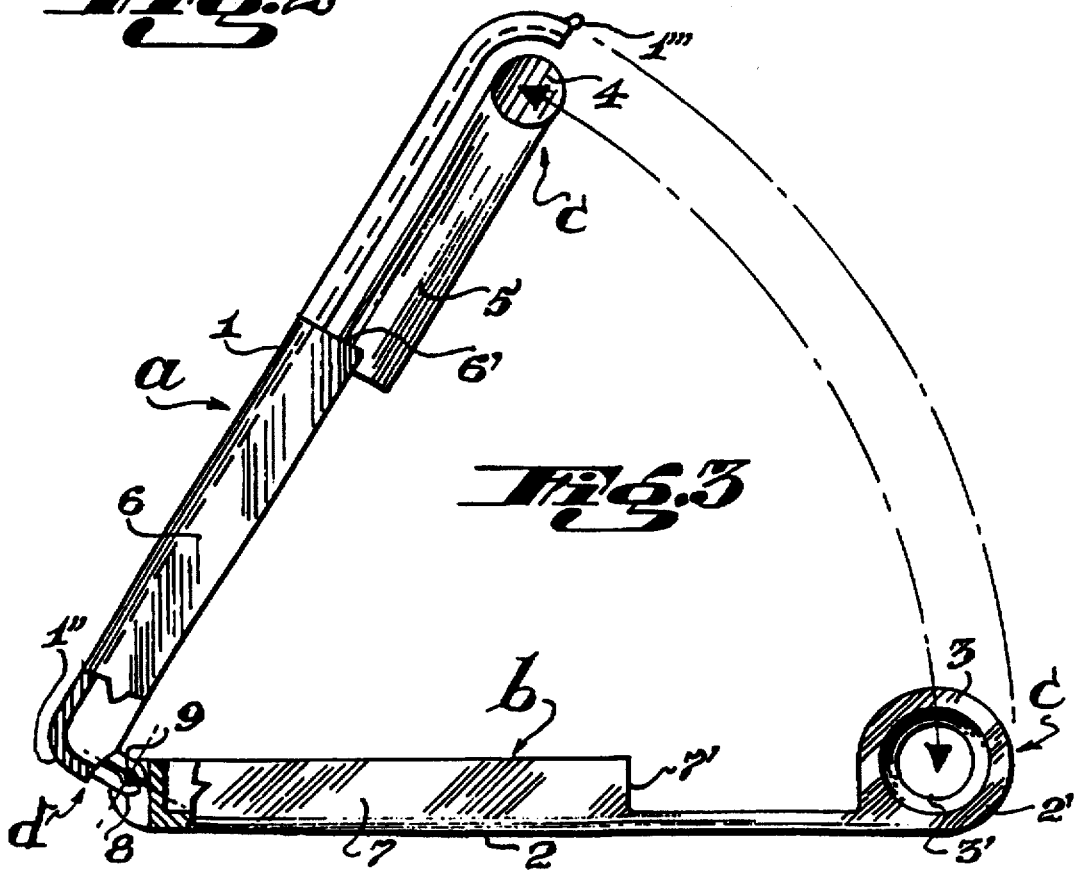
FIG. 3 is a side view with the case in an open position, in the lower box, at the end opposite to the hinging, the wedging end is seen, while in the upper box, the flexibly cedent arm ending in the cam is seen.
Figure 4:
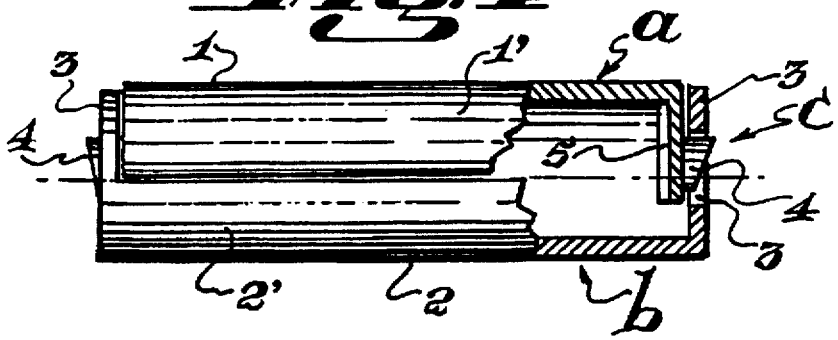
FIG. 4 is a front view of the transversal lateral walls with a section where the cam wedged in the opening of the wedging end is clearly seen.
Figure 5:
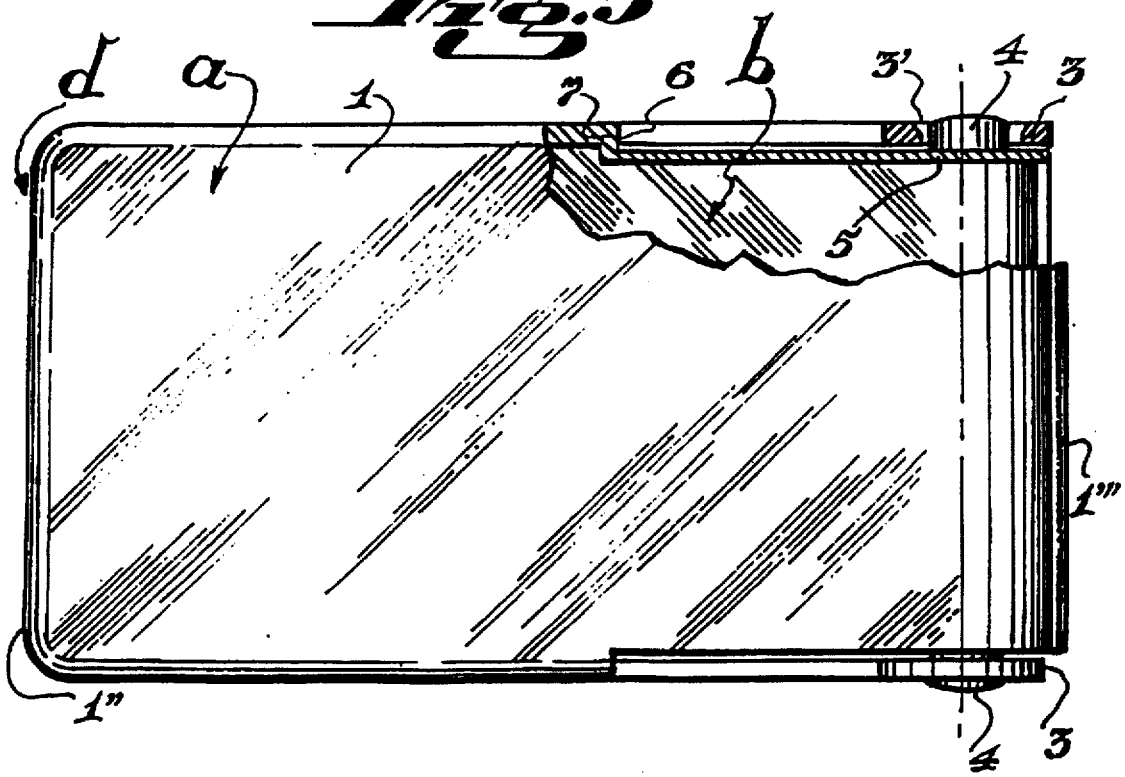
FIG. 5 is a top view of the case where the section shows one of the arms and its corresponding cam wedged in the respective opening.
Figure 6:
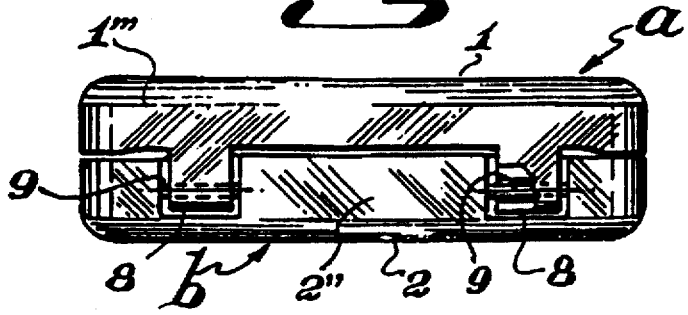
FIG. 6 is a posterior view where the hinging means are seen as well as their respective lateral walls.
Figures 7, 8, 9:
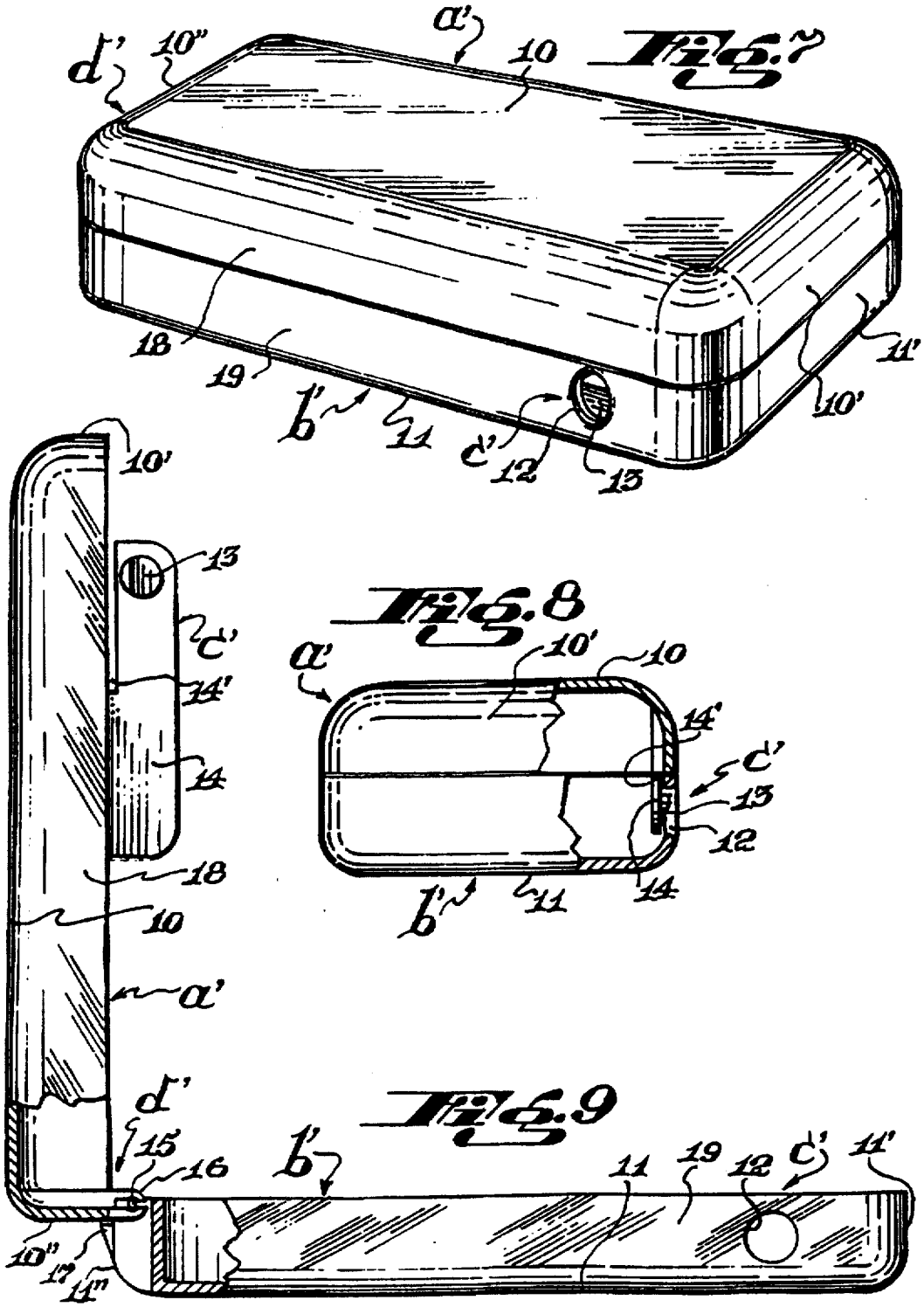
FIG. 7 is a view in perspective that shows the general conformation of the case, in an embodiment where the longitudinal lateral walls laterally shut both boxes.
FIG. 8 is a front view of the case of FIG. 7, where the partial transversal section allow the viewing of the connected shutting means.
FIG. 9 is a side view of the case in FIG. 7 with both boxes in an open position, the partial longitudinal section allowing the viewing in detail the hinging means in both boxes.
Figure 10:
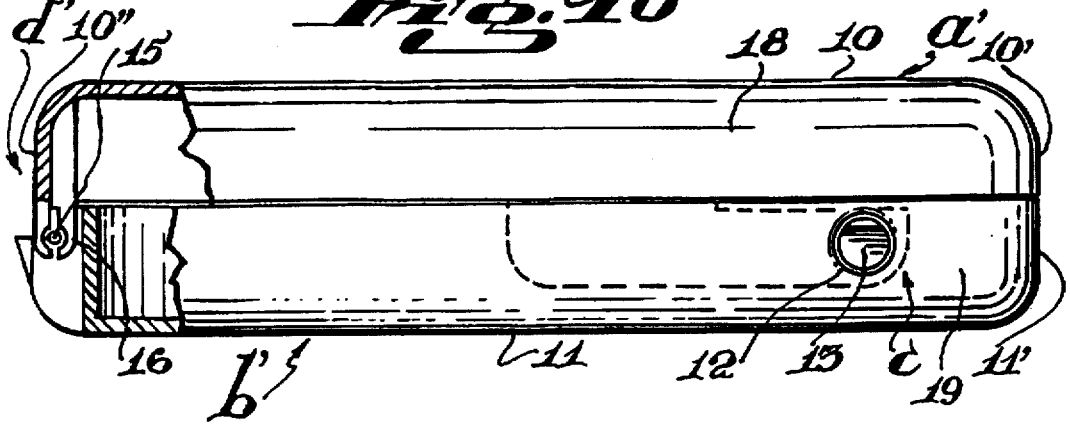
FIG. 10 is a view similar to FIG. 9 but with both boxes in a shut position, the dotted line showing the position of the flexibly cedent arm.
Figure 11:
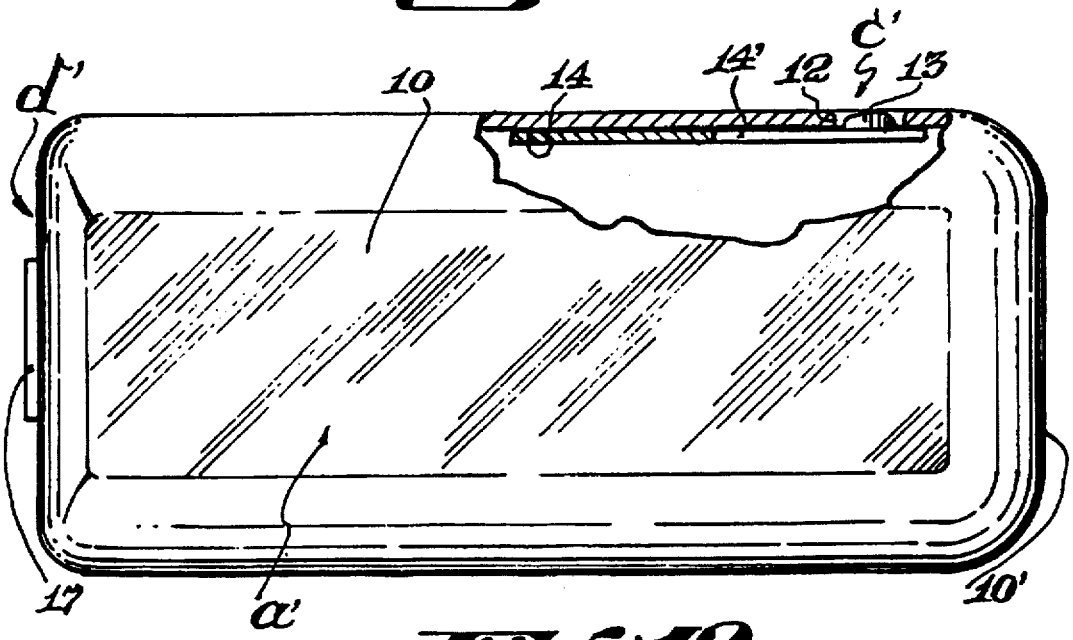
FIG. 11 is a top view of the case in FIG. 7, where the partial section allows the view of the disposal of the flexibly cedent arm and the wedge of the cam in the opening.
Figure 12:
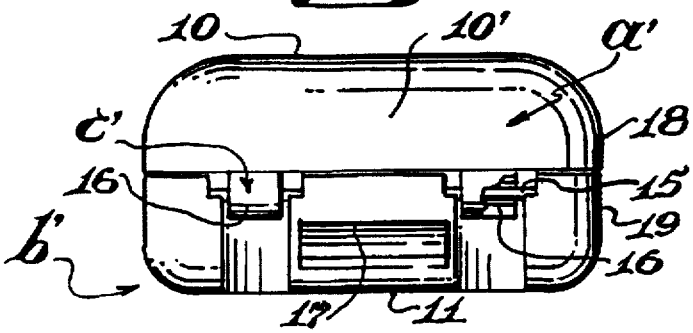
FIG. 12 is a posterior view of the case where the hinging means are seen, as well as the opening stop of both boxes.

List of the main references:

(a) first box
(a') first box (shut)
(b) second box
(b') second box (shut)

(c) (c') shutting means
(d) (d') hinging means
(1) main wall of (a)
(1') opening transversal lateral wall of (a)
(1") hinging transversal lateral wall of (a)
(1"') opening edge of (a)
(2) main wall of (b)
(2') opening transversal lateral wall of (b)
(2") hinging transversal lateral wall of (b)
(3) wedging ends of (c)
(3') opening of (3) for the wedging of (4)
(4) cam of (c)
(5) flexibly cedent arms
(6) longitudinal lateral wall of (a)
(6') end of (6)
(7) longitudinal lateral wall of (b)
(7') end of (7)
(8) small prehensile pincers of (d)
(9) axle of (d)
(10) main wall of (a')
(10') opening transversal lateral wall of (a')
(10") hinging transversal lateral wall of (a')
(11) main wall of (b')
(11') opening transversal lateral wall of (b')
(11") hinging transversal lateral wall of (b')
(12) openings of (19) for the wedging of (13)
(13) cam of (c')
(14) flexibly cedent arms of (a')
(15) axle of (d')
(16) small prehensile pincers of (d')
(17) opening stopper
(18) longitudinal lateral wall of (a')
(19) longitudinal lateral wall of (b')

SUMMARY OF THE INVENTION

Improvement in cases for glasses of the type comprehending two boxes (a) and (b) that are elongated and hinged among each other and complement their respective cavities opposite to each other to define the admission receptacle for the glasses. The boxes are formed by respective main walls (1) and (2), obverse and reverse of the case, respectively. In each one of them originate the lateral walls (1) (6) (1") and are opposed in a confronting way and include retentive means (c) disposed towards the opposite area of the hinge (d). Two of the opposed lateral walls (6) of one of the boxes (a) comprehend respective flexibly cedent arms (5). Projecting from their free ends, cams (4) which are forcibly wedged and auto-retainable in respective compatible openings (3') in the other box (b). The cam (4) and the openings (3') form a shutting means (c). The commanding means (1"') is located in the lateral (1') opposed to the hinging wall (1").

DETAILED DESCRIPTION OF THE PREFERRED EMBODIMENT

The present invention refers to improvements in cases for glasses.

The present improvements have been practiced in a case that comprehends first (a) and a second (b) elongated boxes with their respective opposable cavities defining the receptacle for admission of the glasses. Boxes (a) and (b) are provided with hinging means (d) constituted by small prehensile pincers (8) and axles (9), also having a shutting means of the case.

More particularly, the first box (a) is an elongated body having a main wall (1) and lateral walls (1'), (6) and (1") that define a cavity. These lateral walls comprise a hinging transversal wall (1") that ends in small prehensile pincers (8), an opening transversal wall (1') ended in an opening edge (1"') and two longitudinal lateral walls (6).

Each one of these longitudinal lateral walls (6) are shorter than the box (a) and ends in an end (6') from which a flexible cedent arm (5) projects. Cedent arm (5) is ended in a cam (4).

This cam (4) is a ledge of a gradually variable thickness at an inclined plane. Its thinner section is located opposite the cavity of the second box (b) that comprises a shutting means (c). The cam (4) is forcibly wedged and auto-retained in a compatible corresponding wedging opening (3') conformed by the second box (b) when the case is closed.

The second box (b) comprises a main wall (2) and four lateral walls, a transversal hinging wall (2"), an opening transversal wall (2') and two longitudinal walls (7). The latter (7) has a length equal to the length of the longitudinal walls (6) of the other box (a), each one terminating with wedging ends (7') of the flexibly cedent arms (5).

From the wedging ends (7'), the main wall (2) continues extending, its laterals edges ending at respective wedging ends (3) for the cams (4). Wedging ends (3) have respective compatible openings (3') into which cams (4) are engaged.

According to one embodiment, between the ends (6') (7') of the longitudinal lateral walls (6) (7) and the wedging ends (3) is an inlet opening to the case which is defined so that, in a shutting position, it is at least partially blinded by the flexibly ceding arms (5).

The wedging openings (3') of the cams (4) go across the walls of the wedging end (3) in such a way that pulsation openings for each of the cams (4) are formed in the external part of the box (b). In this way, when the case is in a shut position, the openings (3') constitute opening means that leave exposed the top faces of the cams (4).

In another embodiment of the present case, the longitudinal lateral walls (18) and (19) of both boxes (a') and (b') are of the same length as the respective adjacent main walls (10) and (11). In this way, a first box (a') and a second box (b') conform with each other laterally when the case is shut.

Similar to the first embodiment both boxes (a') and (b') are provided with hinging means (d') comprising small prehensile pincers (16) and axles (15).

Both boxes (a') and (b') are provided with respective shutting means (c'). More particularly, from the internal faces of the longitudinal lateral walls (18) of the first box (a') project the flexibly cedent arms (14), finding at their free ends one of the shutting means (c') constituted by the cam (13).

In the case of the second box (b'), its longitudinal lateral walls (19) present respective openings (12) for engaging the cams (13) of the first box (a').

Functioning of the set:

When the open case according to the present invention is disposed towards the closed position, the boxes (a) and (b), which are hingedly connected by way of the axles (9) and the small pincers (8), get close until the lateral longitudinal walls (6) and (7) of both boxes (a) and (b) are oppositely confronted. In those conditions, the flexibly cedent arms (5) of the first box (a) dispose themselves in an adjacent way in the inside of the wedging ends (3) of the second box (b). As the case is closed, the top faces of the cams (4) slide by the edges of the wedging ends (3) until the cams (4) wedge in a forced and auto-retentive way in the respective wedging openings (3').

In this position, the top faces of the cams (4) are left exposed in the respective wedging openings (3'), so that when the operator pushes the cams through the openings (3'), the flexibly cedent arms (5) are displaced, allowing the unwedging of the cams (4) so they may be extracted from the wedging ends (3).

In this disposition, the opening edge (1"') is useful to effect the separation between the boxes (a) and (b) and thus to open the case.

The boxes (a') and (b') are laterally shut in a similar way. Although unlike boxes (a) and (b) with shorter longitudinal lateral walls (6) and (7), when boxes (a') and (b') are shut, lateral walls (18) and (19) cover the flexibly cedent arms (14). The latter (14) are disposed internally behind the longitudinal lateral walls (19) of the second box (b') in such a way the cams (13) wedge in the respective openings (12). In this condition, boxes (a') and (b') define a shut receptacle.

Indubitably, when this invention is put into practice, modifications may be introduced concerning details in construction and shape, without departing from the fundamental principles of the present invention.

I claim:

1. A case for glasses comprising:

a first box comprising a rectangular base having a first and second short edge and a first and second long edge, each said edge having a lateral wall associated with it, said lateral walls defining a first cavity;

a second box comprising a rectangular base having a first and second short edge and a first and second long edge, each said edge having a lateral wall associated with it, said lateral walls defining a second cavity, said second box being substantially the same size and shape as said first box;

said lateral walls associated with said first short edge in said first and second box being hingedly connected, said first and second cavities defining a receptacle for glasses;

said second box having a hole in said lateral wall associated with each of said first and second long edge near said second short edge;

said first box having a lateral projection extending from the inner side of the lateral wall associated with each of said first and second long edge, each said lateral projection terminating in a cam with a variable thickness and comprising an inclined surface;

each said cam of said first box cooperating with said hole in the opposing lateral wall of said second box.

2. A case for glasses as in claim 1, wherein each said lateral projection comprises a flap parallel to said associated lateral wall and having an outer edge, each said flap originating at a point approximately halfway between said first and second short edges and being fixedly attached thereto, each said flap extending freely to substantially said second short edge whereby said flap can be flexibly moved towards the interior of said case.

3. A case for glasses as in claim 1, wherein said lateral projections are not substantially covered by said lateral walls associated with each of said first and second long edges in said first and second boxes when said case is shut.

4. A case for glasses as in claim 1, wherein said lateral projections are completely covered by said lateral walls associated with each of said first and second long edge in said first and second boxes when said case is shut.

5. A case for glasses as in claim 1, further including a commanding means located on the lateral wall associated with the second short edge of said first box to aid in opening and shutting said case.

6. A case for glasses as in claim 5, wherein said commanding means comprises a ledge extending outward from the lateral wall associated with the second short edge of said first box.

7. A case for glasses as in claim 2, wherein each said cam comprises a circular projection having a free inclined surface, the thickness of said cam nearest to said outer edge having substantially the same thickness as said flap at said bottom edge.

* * * * *